US011788529B2

(12) United States Patent
Zhang et al.

(10) Patent No.: US 11,788,529 B2
(45) Date of Patent: Oct. 17, 2023

(54) ELECTRIC MOTOR WITH INTEGRATED HYDRAULIC PUMP AND MOTOR CONTROLLER

(71) Applicant: Parker-Hannifin Corporation, Cleveland, OH (US)

(72) Inventors: Hao Zhang, Twinsburg, OH (US); Satish Kumar Raju Kalidindi, Mayfield Heights, OH (US); Steven Huard, New Elm, MN (US); Yu-Sen Chu, Westlake, OH (US); Suresh Natarajan, Twinsburg, OH (US); Brian Burgess, Burleson, TX (US); Frank Iannizzaro, Canfield, OH (US); Patrick Toops, Irvine, CA (US); Robb Fisher, Fort Worth, TX (US)

(73) Assignee: Parker-Hannifin Corporation, Cleveland, OH (US)

( * ) Notice: Subject to any disclaimer, the term of this patent is extended or adjusted under 35 U.S.C. 154(b) by 182 days.

(21) Appl. No.: 17/429,066

(22) PCT Filed: Jun. 23, 2020

(86) PCT No.: PCT/US2020/039095

§ 371 (c)(1),
(2) Date: Aug. 6, 2021

(87) PCT Pub. No.: WO2021/011155

PCT Pub. Date: Jan. 21, 2021

(65) Prior Publication Data

US 2022/0128052 A1 Apr. 28, 2022

Related U.S. Application Data

(60) Provisional application No. 62/967,877, filed on Jan. 30, 2020, provisional application No. 62/873,315, filed on Jul. 12, 2019.

(51) Int. Cl.

| | |
|---|---|
| ***F04C 15/00*** | (2006.01) |
| ***F04B 17/03*** | (2006.01) |
| ***F04C 2/10*** | (2006.01) |

(52) U.S. Cl.
CPC ..... *F04C 15/0061* (2013.01); *F04B 17/03* (2013.01); *F04C 2/10* (2013.01)

(58) Field of Classification Search
CPC .... F04C 2/08–20; F04C 11/008; F04C 14/00; F04C 15/0057–0073; F04C 15/008;
(Continued)

(56) References Cited

U.S. PATENT DOCUMENTS

2012/0211093 A1* 8/2012 Grimes ..... F04B 53/08 417/313

FOREIGN PATENT DOCUMENTS

CN 2937559 Y * 8/2007
CN 103 742 776 A 4/2014
(Continued)

OTHER PUBLICATIONS

Notice of the Reason for Refusal prepared by the Japanese Patent Office in application No. 2021-555788 dated Sep. 20, 2022.
(Continued)

*Primary Examiner* — Alexander B Comley
(74) *Attorney, Agent, or Firm* — McDonnell Boehnen Hulbert & Berghoff LLP

(57) ABSTRACT

An example assembly comprises: a main housing; an electric motor disposed in the main housing and comprising a stator fixedly positioned in the main housing, and a rotor positioned within the stator; a hydraulic pump positioned in the main housing and at least partially within the rotor, wherein the hydraulic pump is configured to receive fluid from an inlet port and provide fluid flow to an outlet port, wherein the hydraulic pump comprises a pump shaft rotatably coupled to the rotor of the electric motor; a controller housing coupled to the main housing; and a motor controller comprising one or more circuit boards disposed within the controller housing and configured to generate electric current to drive the electric motor.

20 Claims, 10 Drawing Sheets

(58) Field of Classification Search
CPC ..... F04C 2240/40; F04C 2240/403; F04C 2240/808; H02K 11/33; F04B 17/03; F04B 49/06–065; F04B 2201/1208; F04D 25/0606
See application file for complete search history.

(56) References Cited

FOREIGN PATENT DOCUMENTS

| | | | | |
|---|---|---|---|---|
| CN | 204126888 | U | * | 1/2015 |
| JP | 2011 074843 | A | | 4/2011 |
| JP | 2011-152445 | A | | 8/2011 |
| JP | 2013072495 | A | * | 4/2013 |
| JP | 2013217237 | A | * | 10/2013 |
| JP | 2014 125955 | A | | 7/2014 |
| JP | 2014125955 | A | * | 7/2014 |
| WO | WO 2014/115249 | A1 | | 7/2014 |

OTHER PUBLICATIONS

Notice of Preliminary Rejection prepared by the Korean Patent Office in application No. 10-2021-7031301 dated Jan. 30, 2023.
International Search Report and Written Opinion prepared by the European Patent Office in application No. PCT/US2020/039095 dated Sep. 23, 2020.
First Examination Report prepared by the Indian Patent Office in application No. 202117043672 dated Apr. 4, 2022.

* cited by examiner

ELECTRIC MOTOR WITH INTEGRATED HYDRAULIC PUMP AND MOTOR CONTROLLER

CROSS-REFERENCE TO RELATED APPLICATION

This application claims priority to U.S. Provisional Application No. 62/873,315, filed Jul. 12, 2019 and U.S. Provisional Application No. 62/967,877, filed Jan. 30, 2020, which are incorporated herein by reference in their entirety.

BACKGROUND

An electric motor can be used to drive a hydraulic pump. For example, an output shaft coupled to a rotor of the electric motor can be coupled to a shaft of the hydraulic pump, such that rotation of the rotor can cause a rotating group of the hydraulic pump to rotate and provide fluid flow.

A motor controller is typically separate from the motor and is connected to wire windings of a stator of the electric motor via cables. The motor controller can include an inverter having a switchable matrix of transistors that can convert direct current power to alternating current, three-phase, power to drive the motor.

It may be desirable to have an assembly that integrates the hydraulic pump and the motor controller with the electric motor. This way, mechanical components, such as shafts, bearing, etc., can be shared between hydraulic pump and the motor. Further, integrating the motor controller with the electric motor can reduce number and lengths of cables between the controller and electric motor. Such integrated configurations can thus reduce manufacturing cost, enhance reliability, and render the assembly more compact than having separate components. It is with respect to these and other considerations that the disclosure made herein is presented.

SUMMARY

The present disclosure describes implementations that relate to an electric motor with integrated hydraulic pump and motor controller.

In a first example implementation, the present disclosure describes an assembly comprising: (i) a main housing having an internal chamber therein; (ii) an electric motor disposed in the internal chamber of the main housing and comprising (a) a stator fixedly positioned in the internal chamber of the main housing, and (b) a rotor positioned within the stator; (iii) a hydraulic pump positioned in the main housing and at least partially within the rotor of the electric motor, wherein the hydraulic pump is configured to receive fluid from an inlet port and provide fluid flow to an outlet port, wherein the hydraulic pump comprises a pump shaft rotatably coupled to the rotor of the electric motor; (iv) a controller housing coupled to the main housing; and (v) a motor controller comprising one or more circuit boards disposed within the controller housing and configured to generate electric current to drive the electric motor.

In a second example implementation, the present disclosure describes a system comprising: a source of direct current power; a fluid reservoir; a hydraulic actuator; and an assembly. The assembly comprises: (i) a main housing having an internal chamber therein; (ii) an electric motor disposed in the internal chamber of the main housing and comprising (a) a stator fixedly positioned in the internal chamber of the main housing, and (b) a rotor positioned within the stator; (iii) a hydraulic pump positioned in the main housing and at least partially within the rotor of the electric motor, wherein the hydraulic pump is configured to receive fluid from an inlet port fluidly coupled to the fluid reservoir and provide fluid flow to an outlet port fluidly coupled to the hydraulic actuator, wherein the hydraulic pump comprises a pump shaft rotatably coupled to the rotor of the electric motor; (iv) a controller housing coupled to the main housing; and (v) a motor controller comprising one or more circuit boards disposed within the controller housing, wherein the one or more circuit boards are configured to receive direct current power from the source of direct current power and generate electric current to drive the electric motor.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

The present disclosure relates to integrating or embedding a hydraulic pump and a motor controller (including an electronic drive device such as an inverter) with an electric motor to have an assembly providing a compact configuration that reduces cost by sharing components, saves space, and enhances reliability.

Figure 1:
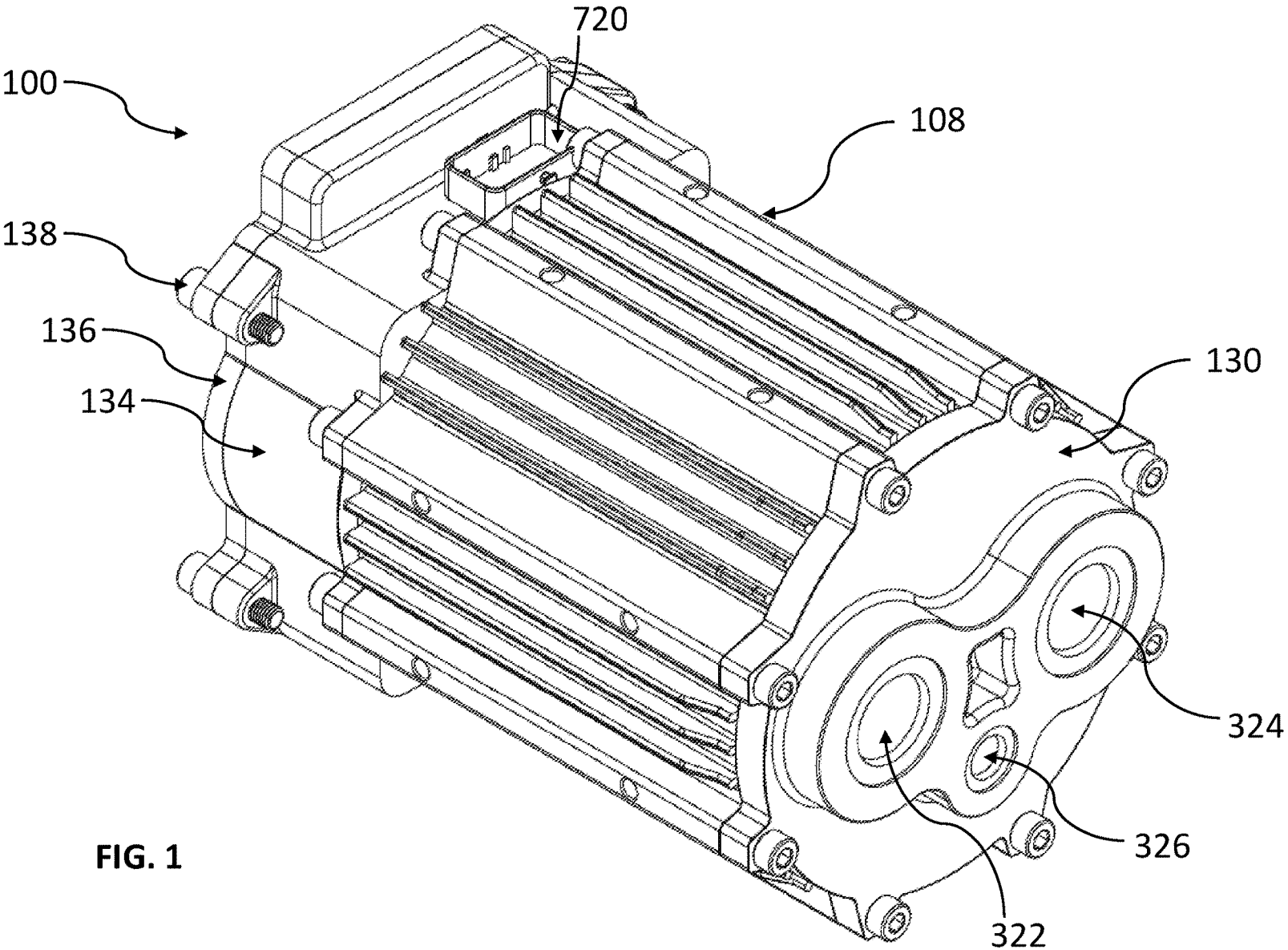
FIG. 1 illustrates a perspective view of an assembly, in accordance with an example implementation.
Figure 2:
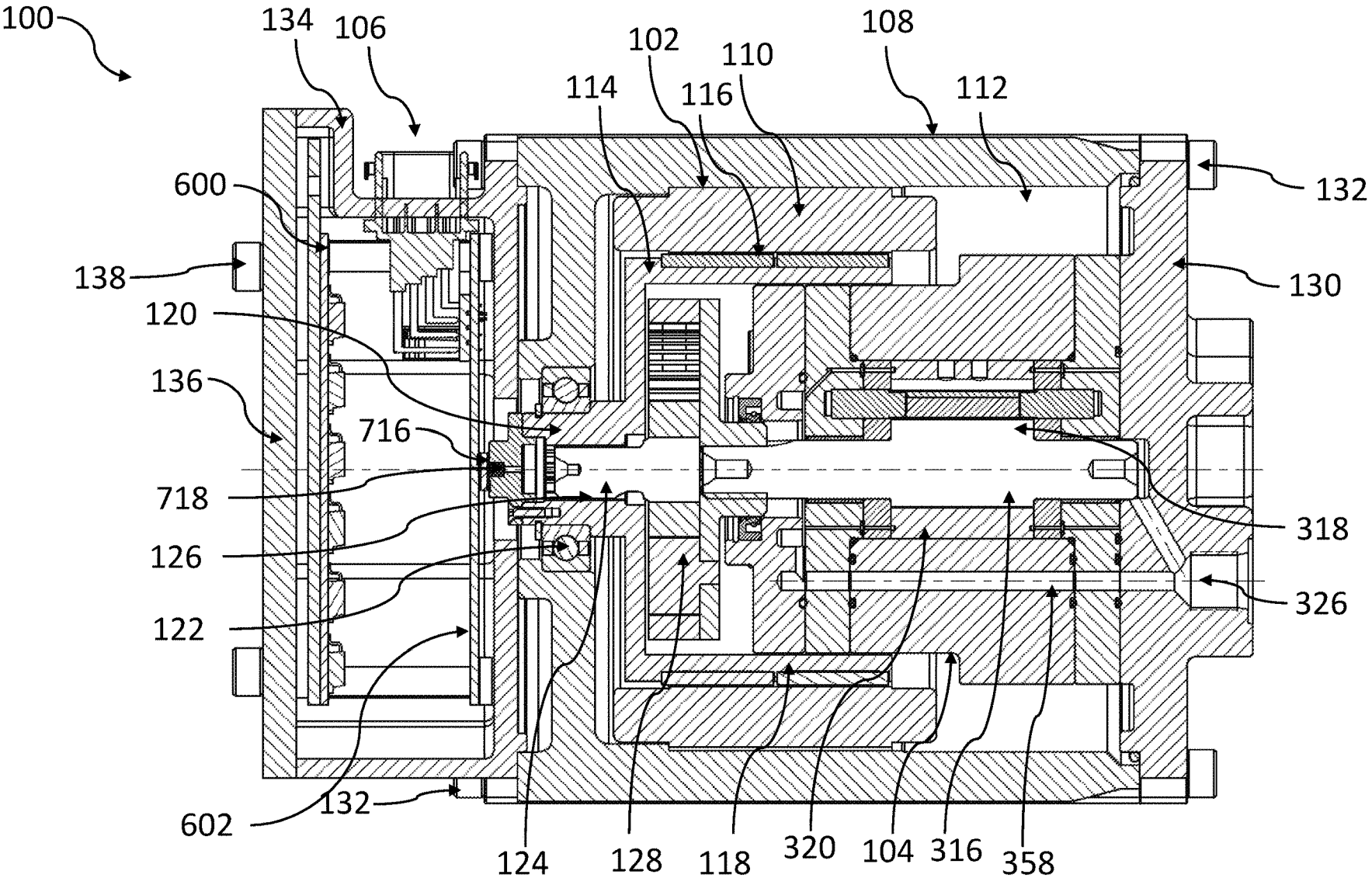
FIG. 2 illustrates a cross-sectional side view of the assembly of FIG. 1, in accordance with an example implementation.

FIG. 1 illustrates a perspective view of an assembly 100, and FIG. 2 illustrates a cross-sectional side view of the assembly 100, in accordance with an example implementation. The assembly 100 comprises an electric motor 102, a hydraulic pump 104, and a motor controller 106 integrated together. The assembly 100 includes a main housing 108 having an internal chamber 112 therein in which components of the electric motor 102 and the hydraulic pump 104 are disposed.

The electric motor 102 includes a stator 110 fixedly positioned within the internal chamber 112 of the main housing 108. The stator 110 is configured to generate a magnetic field. Particularly, the stator 110 can include wire windings (not shown) wrapped about a body (e.g., a lamination stack) of the stator 110, and when electric current is provided through the wire windings, a magnetic field is generated.

The electric motor 102 further includes a rotor 114 positioned in an annular space within the stator 110. The electric motor 102 can further include magnets 116 mounted to the rotor 114 in an annular space between the stator 110 and the rotor 114. The magnets 116 are configured to interact with the magnetic field generated by the stator 110 in order to rotate the rotor 114 and produce torque. In other example implementation, a different type of electric motor might be used that does not include permanent magnets).

The rotor 114 can have a cylindrical portion 118 and a spindle portion 120. The spindle portion 120 is supported within the main housing 108 via a bearing 122 to allow the rotor 114 to rotate relative to the main housing 108. In examples, the spindle portion 120 can be rotatably coupled to a rotor shaft 124 via splines 126. In these examples, the rotor shaft 124 can be rotatably coupled to a gearbox, such as planetary gearbox 128 described below.

The hydraulic pump 104 is mounted within the main housing 108 and, at least partially, within the rotor 114 and the stator 110 of the electric motor 102. Particularly, the hydraulic pump 104 can be fixedly mounted to an end cover 130 that is coupled to the main housing 108 via a plurality of fasteners or bolts such as bolt 132.

Figure 3:
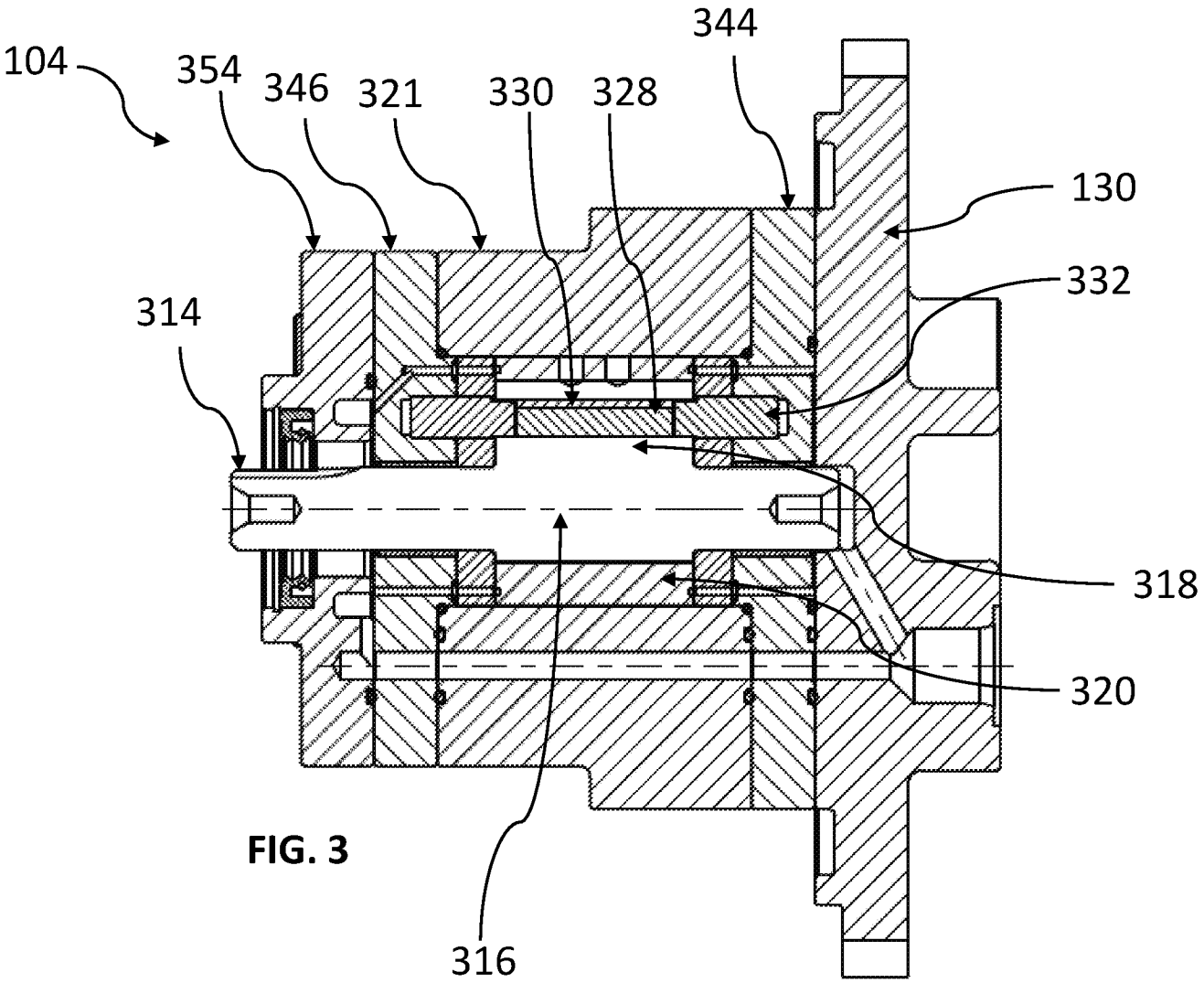
FIG. 3 illustrates a cross-sectional side view of a hydraulic pump and an end cover, in accordance with another example implementation.
Figure 4:
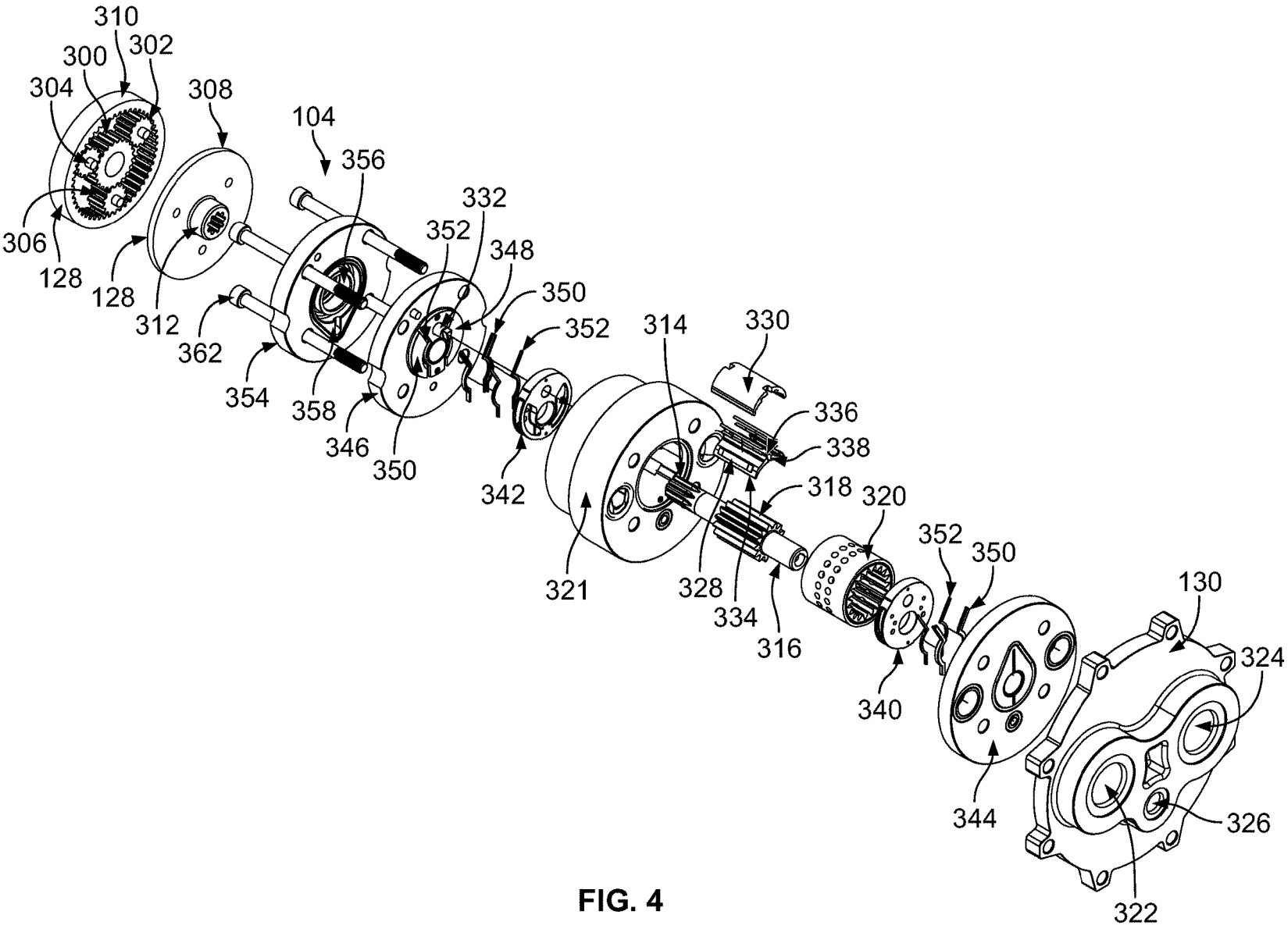
FIG. 4 illustrates a partial perspective exploded view of the assembly of FIG. 1 depicting a planetary gearbox, a hydraulic pump, and an end cover, in accordance with an example implementation.

FIG. 3 illustrates a cross-sectional side view of the hydraulic pump 104 and the end cover 130, and FIG. 4 illustrates a partial perspective exploded view of the assembly 100 depicting the planetary gearbox 128, the hydraulic pump 104, and the end cover 130, in accordance with an example implementation. FIGS. 3 and 4 are described together.

The planetary gearbox 128 shown in FIG. 4 can include a sun gear 300 that is rotatably coupled to the rotor shaft 124 described above. As mentioned above, the spindle portion 120 of the rotor 114 is coupled to the rotor shaft 124 via the splines 126, and thus as the rotor 114 rotates, the rotor shaft 124 and the sun gear 300 coupled thereto can rotate as well.

The planetary gearbox 128 can also include a plurality of planet gears such as first planet gear 302, second planet gear 304, and third planet gear 306. The planetary gearbox 128 is configured such that the respective centers of rotation of the planet gears 302-306 revolve around the center of the sun gear 300.

The planetary gearbox 128 can further include a planetary carrier 308 configured to couple the centers of the planet gears 302-306 to the center of the sun gear 300. The planetary carrier 308 can rotate, while carrying the planet gears 302-306 around the sun gear 300. Further, the planet gears 302-306 are configured to engage with inner teeth of a gearbox ring gear 310 such that the planet gears 302-306 can roll on a pitch circle of the gearbox ring gear 310.

With this configuration, as the rotor 114 rotates, the rotor shaft 124 and the sun gear 300 can rotate, causing the planet gears 302-306 to rotate around the sun gear 300, rolling about the gearbox ring gear 310, thereby causing the planetary carrier 308 to rotate as well. The planetary carrier 308 can have a hub 312 having inner teeth configured to engage with splines 314 of a pump shaft 316 to transmit rotary motion thereto.

It should be understood that the configuration of the planetary gearbox 128 is described and shown as an example for illustration only. Other configurations of gearboxes can be used. The planetary gearbox 128 can be used as a speed reducer to reduce rotational speed of the electric motor 102 to a slower rotary speed for the hydraulic pump 104. In other example implementations, a gearbox might not be used and the pump shaft 316 can be coupled directly to the spindle portion 120 via the splines 314.

The hydraulic pump 104 can be configured, for example, as a gear pump. Particularly, in the example implementation shown in the Figures, the hydraulic pump 104 is configured as an internal gear pump having a pump pinion 318 (e.g., an external spur gear having external teeth formed in an exterior peripheral surface thereof) and a pump ring gear 320 (e.g., ring gear having internal teeth formed in an interior peripheral surface thereof) disposed within a pump housing 321, such that external teeth of the pump pinion 318 are configured to engage with internal teeth of the pump ring gear 320. As depicted in FIGS. 3-4, the pump pinion 318 is mounted to, or is an integral portion of, the pump shaft 316, and the teeth of the pump pinion 318 engage with the teeth of the pump ring gear 320.

Figure 5:
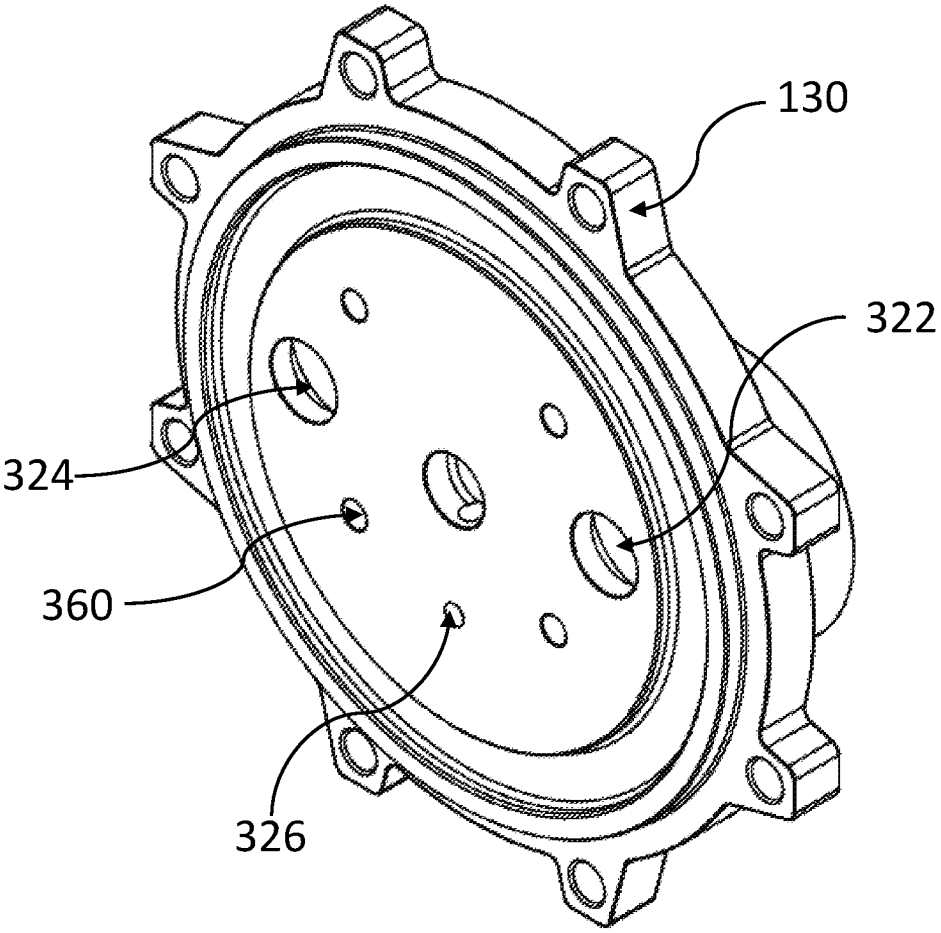
FIG. 5 illustrates a perspective view of the end cover of FIG. 4, in accordance with an example implementation.

FIG. 5 illustrates a perspective view of the end cover 130, in accordance with an example implementation. As shown in FIGS. 1, and 4-5, the end cover 130 can have an inlet port 322 configured to receive fluid from a fluid reservoir fluidly coupled to the assembly 100 (e.g., via a hose of any hydraulic line). The end cover 130 also includes an outlet port 324 for providing pressurized fluid being output from the hydraulic pump 104 to a hydraulic consumer (e.g., an hydraulic actuator) fluidly coupled to the assembly 100. The end cover 130 further has a drain port 326.

During operation, as the rotor 114 rotates, the pump shaft 316 rotates as described above. As the pump pinion 318 rotates within the pump ring gear 320, their separate or disengage on the intake side of the hydraulic pump 104 that is fluidly coupled to the inlet port 322, creating a void and suction, which is then filled by fluid from the inlet port 322. The fluid is carried by the gear teeth of the pump pinion 318 and the pump ring gear 320 to a discharge side of the hydraulic pump 104, which is fluidly coupled to the outlet port 324. The meshing of the gear teeth of the pump pinion 318 and the pump ring gear 320 displaces the fluid, and the fluid is then provided to the outlet port 324. The hydraulic pump 104 can be drained via a drain leakage line to the drain port 326 to reduce internal pressure of the hydraulic pump 104.

As shown in FIG. 4, the hydraulic pump 104 includes an inner crescent 328 and an outer or upper crescent 330. The inner crescent 328 and the outer or upper crescent 330 are supported by a pivot pin 332 to hold the crescent orientation and seal the pump ring gear 320 and the pump pinion 318 radially. The crescents 328, 330 also operate as radial compensators.

The crescents 328, 330 can be supported by a leaf spring 334 to seal the pump ring gear 320 and the pump pinion 318. Also, the hydraulic pump 104 includes a check valve pin 336 placed between the inner crescent 328 and the outer or upper crescent 330 and is supported by an additional leaf spring 338 to prevent the leakage from a passage or volume having high pressure fluid within the hydraulic pump 104 to a passage or volume having low pressure fluid during operation.

The pump ring gear 320 and the pump pinion 318 are further axially supported by thrust plates 340, 342 on both sides of the pump ring gear 320 and the pump pinion 318. The thrust plates 340, 342 can operate as axial compensator that can reduce the leakage, and improve efficiency of the hydraulic pump 104.

The thrust plates 340, 342 are also supported by a first or front cover 344 and a second or back cover 346. The front cover 344 and the back cover 346 can have pressure compensation pocket 348 supported by a pressure seal 350 and a back seal 352. The pressure compensation pocket 348 can be filled with pressurized fluid received through the thrust plates 340, 342, and the pressurized fluid then helps to push the thrust plates 340, 342 against the pump ring gear 320 and the pump pinion 318 for sealing.

The back cover 346 is further axially supported by a pump end mounting cover 354. The pump end mounting cover 354 can include a lip seal 356 to prevent the leakage into the rotor 114. A cavity in the pump end mounting cover 354 (in which the lip seal 356 is disposed) is connected to the drain port 326 through a drain passage 358 to drain the high pressure fluid from the lip seal cavity.

As shown in FIG. 5, the end cover 130 includes four bolt holes such as bolt hole 360. Referring to FIGS. 4 and 5, the components of the hydraulic pump 104 can be aligned and stacked, then bolted together using socket head bolts, such as bolt 362, which are received in the bolt hole(s) 360 in the end cover 130, to assemble the hydraulic pump 104.

A gear pump is used herein as an example for illustration. It should be understood that other types of pumps such as a vane pump or a piston pump may be used as well.

Referring back to FIGS. 1-2, the assembly 100 further includes a controller housing 134 coupled to the main housing 108. The controller housing 134 is further coupled to a controller housing cover 136 via a plurality of bolts, such as bolt 138. With this configuration, the controller housing 134 and the controller housing cover 136 form an enclosure in which the motor controller 106 is disposed.

Figure 6:
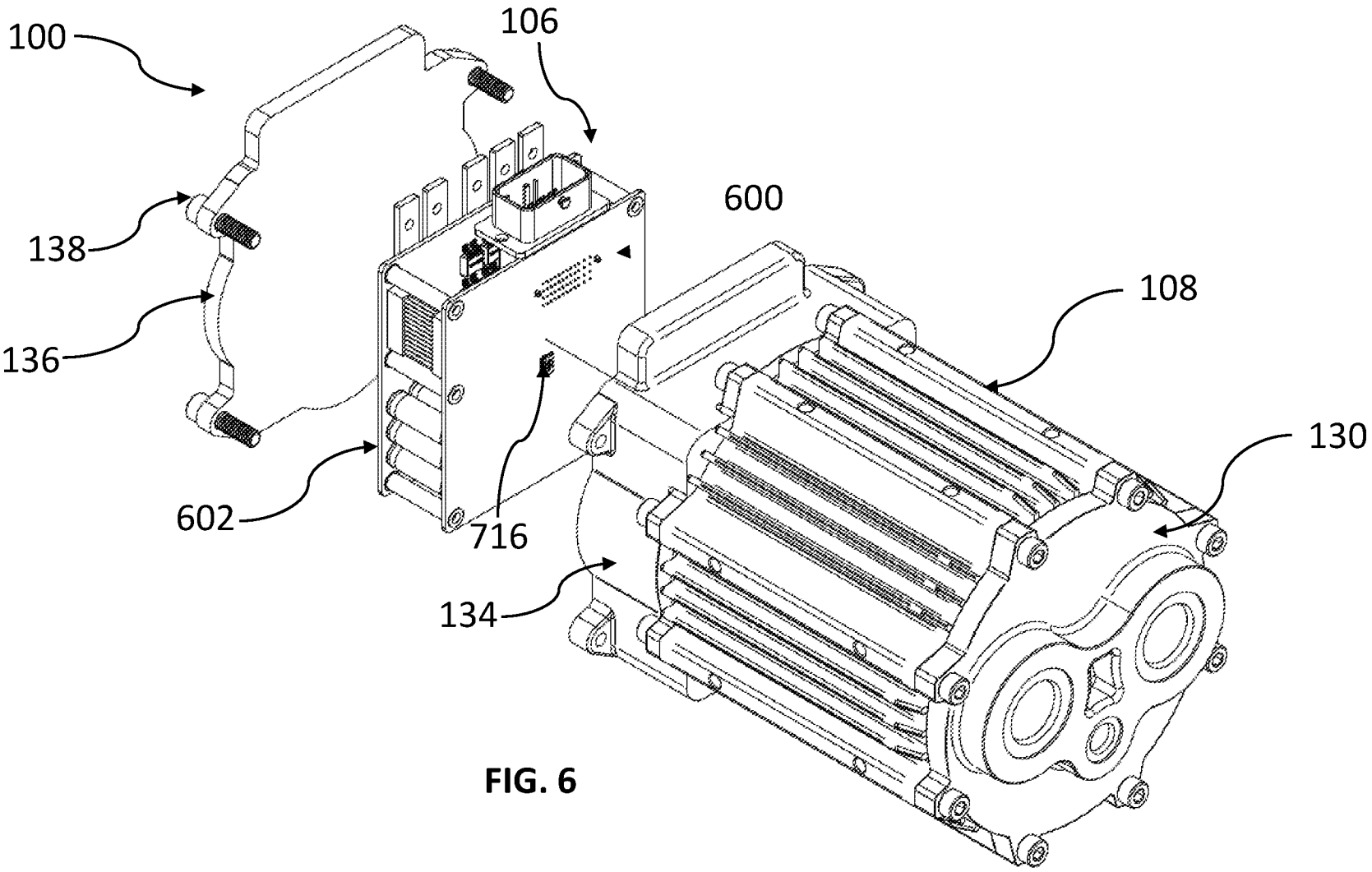
FIG. 6 illustrates a perspective exploded view of the assembly of FIG. 1, in accordance with an example implementation.

FIG. 6 illustrates a perspective exploded view of the assembly 100, in accordance with an example implementation. As shown in FIG. 6, the controller housing 134 and the controller housing cover 136 enclose the motor controller 106. This way, the motor controller 106 is embedded within the assembly 100 and integrated with the electric motor 102 and the hydraulic pump 104 in the assembly 100.

The motor controller 106 can include a controller board 600 and an inverter board 602 that are axially offset from each other as depicted. The controller board 600 and the inverter board 602 can be configured as printed circuit boards (PCBs). A PCB mechanically supports and electrically connects electronic components (e.g., microprocessors, integrated chips (ICs), capacitors, resistors, etc.) using conductive tracks, pads, and other features etched from one or more sheet layers of copper laminated onto and/or between sheet layers of a non-conductive substrate. Components are generally soldered onto the PCB to both electrically connect and mechanically fasten them to it.

Figure 7B:
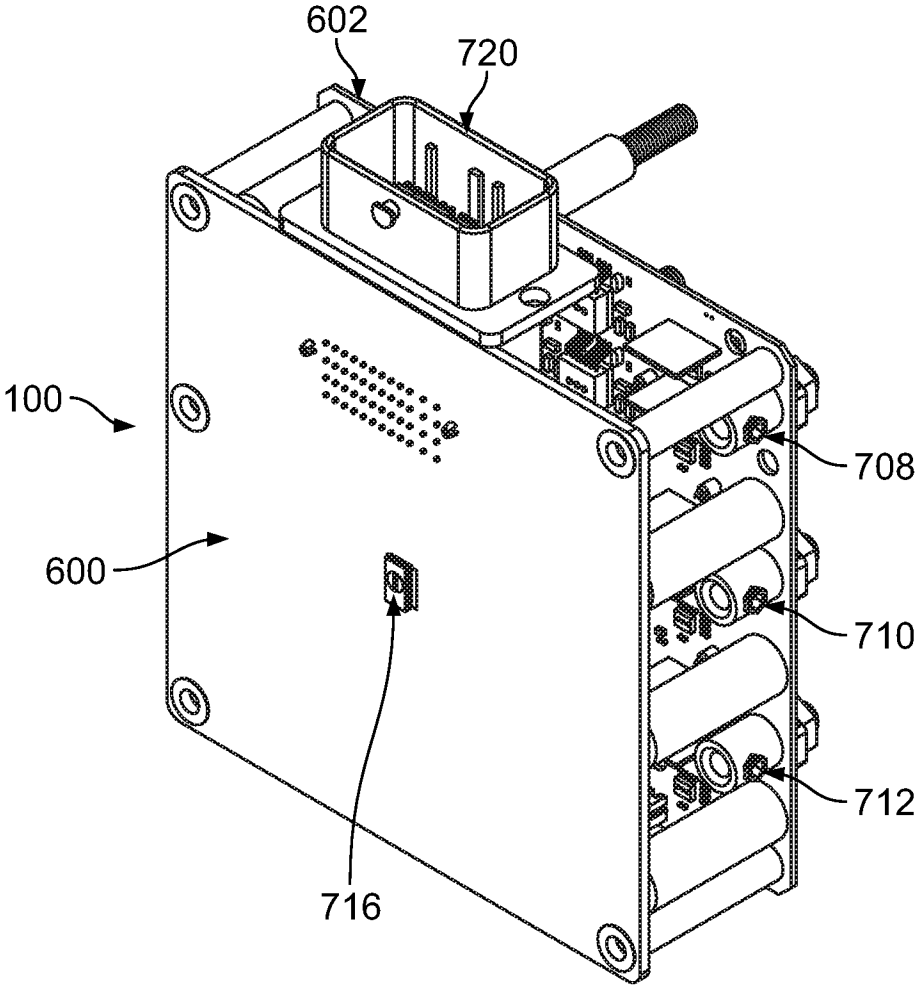
FIG. 7B illustrates another perspective view of the motor controller of FIG. 7A, in accordance with an example implementation.
Figure 7A:
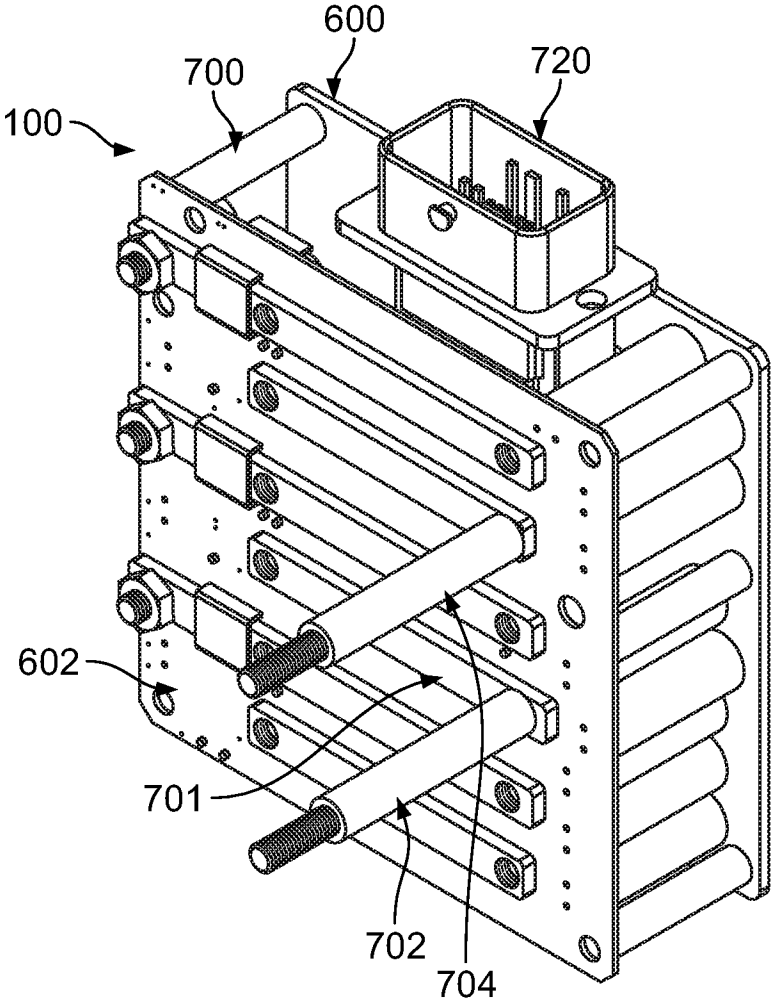
FIG. 7A illustrates a perspective view of a motor controller, in accordance with an example implementation.
Figure 7C:
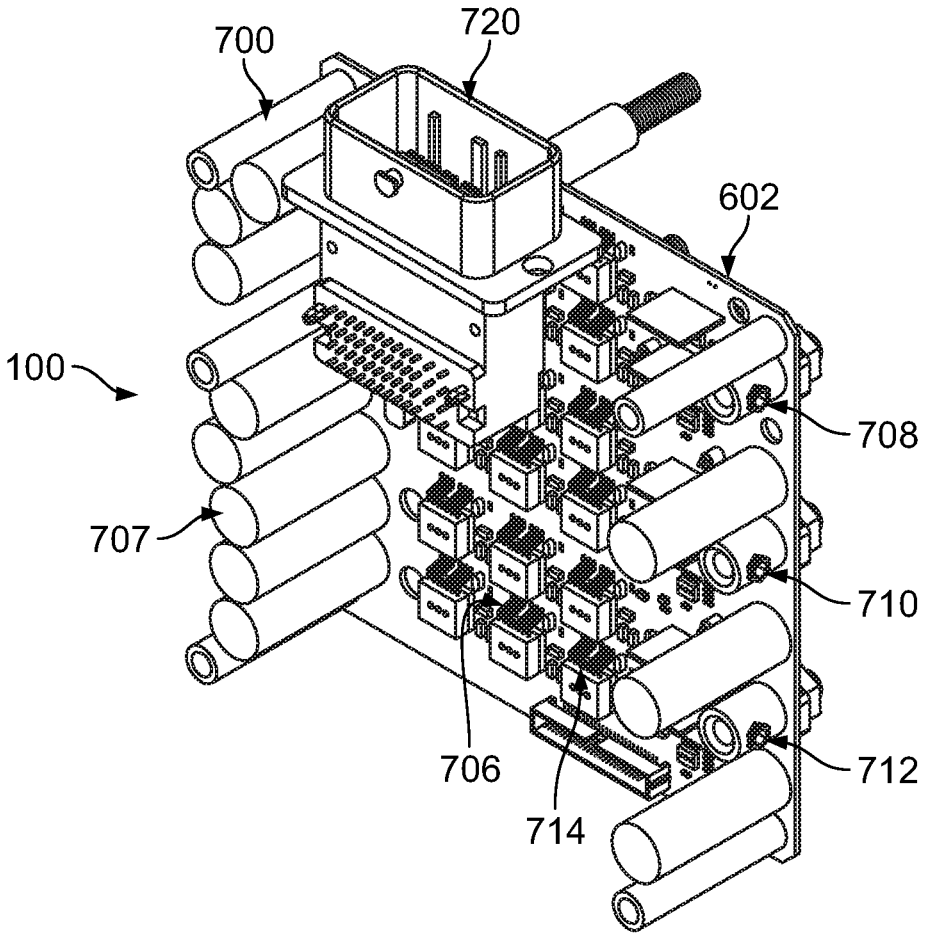
FIG. 7C illustrates a partial perspective view of the motor controller depicting an inverter board, in accordance with an example implementation.

FIG. 7A illustrates a perspective view of the motor controller 106, FIG. 7B illustrates another perspective view of the motor controller 106, and FIG. 7C illustrates a partial perspective view of the motor controller 106 depicting the inverter board 602 without the controller board 600, in accordance with an example implementation. FIGS. 7A-7C are described together.

As shown, the inverter board 602 can be separated from, and coupled to, the controller board 600 via stand-offs such as stand-off 700. The inverter board 602 can include a plurality of bus bars such as bus bar 701 that are laterally disposed across and end face of the inverter board 602, which interfaces with the controller housing cover 136. The bus bars are electrically-conductive and are configured to receive direct current (DC) power and provide the power to components mounted to the opposite side of the inverter board 602.

As an example, the DC power can be provided to the inverter board 602 from a battery via leads such as positive DC lead 702 and negative DC lead 704 (e.g., electric ground). With this configuration, DC power is provided to the bus bars, which then transmit the power to other components of the inverter board 602.

The inverter board 602 can be configured as a power converter that converts DC power received at the inverter board 602 to three-phase, alternating current (AC) power that can be provided to wire windings of the stator 110 to drive the electric motor 102. As shown in FIG. 7C, the inverter board 602 includes a semiconductor switching matrix 706 mounted to the inverter board 602 and configured to be electrically-connected to a positive DC terminal connected to the positive DC lead 702 and to a negative DC terminal connected to the negative DC lead 704. The inverter board 602 can further include a plurality of capacitors, such as capacitor 707 disposed in the axial space between the inverter board 602 and the controller board 600.

The semiconductor switching matrix 706 can include any arrangement of semiconductor switching devices that can support DC to three-phase power conversion. For example, the semiconductor switching matrix 706 can include a three-phase, with bridge elements electrically coupled to input DC terminals (coupled to the DC leads 702, 704) and connected to three-phase AC output terminals 708, 710, and 712.

For example, the semiconductor switching matrix 706 can include a plurality of transistors, such as transistor 714 (e.g., an Insulated Gate Bipolar Transistor or a metal oxide-semiconductor field-effect transistor). The transistors are switchable between an activated or "on" state and a deactivated or "off" state, e.g., via a pulse width modulated (PWM) signal provided by a microprocessor mounted to the controller board 600. A microprocessor can comprise one or more processors. A processor can include a general purpose processor (e.g., an INTEL® single core microprocessor or an INTEL® multicore microprocessor), or a special purpose processor (e.g., a digital signal processor, a graphics processor, or an application specific integrated circuit (ASIC) processor). A processor can be configured to execute computer-readable program instructions (CRPI). A processor can be configured to execute hard-coded functionality in addition to or as an alternative to software-coded functionality (e.g., via CRPI).

As the transistors of the semiconductor switching matrix 706 are activated and deactivated at particular times via the PWM signal, AC voltage waveforms are generated at the AC output terminals 708, 710, and 712. As such, the voltage waveforms at the AC output terminals 708, 710, and 712 are pulse width modulated and swing between voltage potential DC+ and voltage potential DC−. The AC voltage waveforms are then provided to the wire windings of the stator 110 to drive the electric motor 102.

The motor controller 106 can include a plurality of sensors. For example, the motor controller 106 can include temperature sensors configured to provide information indicative of an operating temperature of the electric motor 102 and/or the fluid temperature of hydraulic fluid flowing through the hydraulic pump 104. The motor controller 106 can also include Hall-Effect current sensors that provide information indicative of electric current level in windings of the electric motor 102.

The motor controller 106 can further include a pressure sensor and a rotary position sensor configured to provide sensor information indicative of angular position of the rotor shaft 124 or the pump shaft 316. The rotary position sensor information can be used by the microprocessor controlling the electric motor 102 so as to control speed and torque of produced by the rotor 114 in a closed-loop feedback control configuration.

For example, the controller board 600 can include an encoder 716 to be mounted near the spindle portion 120 of the rotor 114. The encoder 716 can be configured to interact with a magnet 718 shown in FIG. 2 coupled to the rotor shaft 124. The encoder 716 is configured as an electro-mechanical device that converts the angular position or motion of the rotor shaft 124 to analog or digital output signals that are provided to the microprocessor controlling the electric motor 102.

The motor controller 106 can further include an electric connector 720 configured as a hollow plastic component housing a plurality of conductor pins that can be electrically-connected to the conductive tracks of the controller board 600. A connector socket (not shown) having female pins can be mounted to the electric connector 720 such that the conductor pins contact the female pins of the connector socket. Wires can be connected to the female pins so as to provide signals to and received signals from the conductor pins of the electric connector 720.

With this configuration, the motor controller 106 can, for example, receive command signal from a central controller or from an input device of a machine (e.g., a joystick of a hydraulic machine such as a wheel loader, backhoe, or excavator) indicative of a desired fluid pressure and fluid flow rate to be provided by the hydraulic pump 104. The motor controller 106 can then control the AC power provided to the stator 110 to generate a particular speed and torque at the pump shaft 316 to provide the desired fluid pressure level and flow rate. The motor controller 106 can also provide sensor signals (e.g., from the encoder 716) to another central controller via the electric connector 720.

The controller board 600 and the inverter board 602 can include several junctions to facilitate receiving and transmitting signals and power therebetween and to other components of the assembly 100 or external components.

In an example, the assembly 100 can further include a hydraulic manifold configured to be coupled to the assembly 100. For instance, the manifold can be mounted to the end cover 130, and the manifold can include a plurality of solenoid valves and fluid passages, where the solenoid valves control fluid flow through such fluid passages. The manifold can thus control fluid flow to and from the inlet port 322, the outlet port 324, and the drain port 326.

The controller board 600 can include electronic valve drivers that control electric current and voltage signals provided to solenoid coils of the solenoid valves of the manifold to control actuation and state of operation of the solenoid valves. This way, the motor controller 106 can further be configured to control state of operation of the solenoid valves and fluid flow through the manifold.

In operation, the assembly 100, can be used where the electric motor 102 drives the hydraulic pump 104, or where the hydraulic pump 104, drives the electric motor 102 as a generator. As such, the hydraulic pump 104 can be configured as a hydraulic pump/motor capable of operating as a four-quadrant bi-directional pump capable of energy recovery as well as providing fluid power to a hydraulic actuator.

Figure 8:
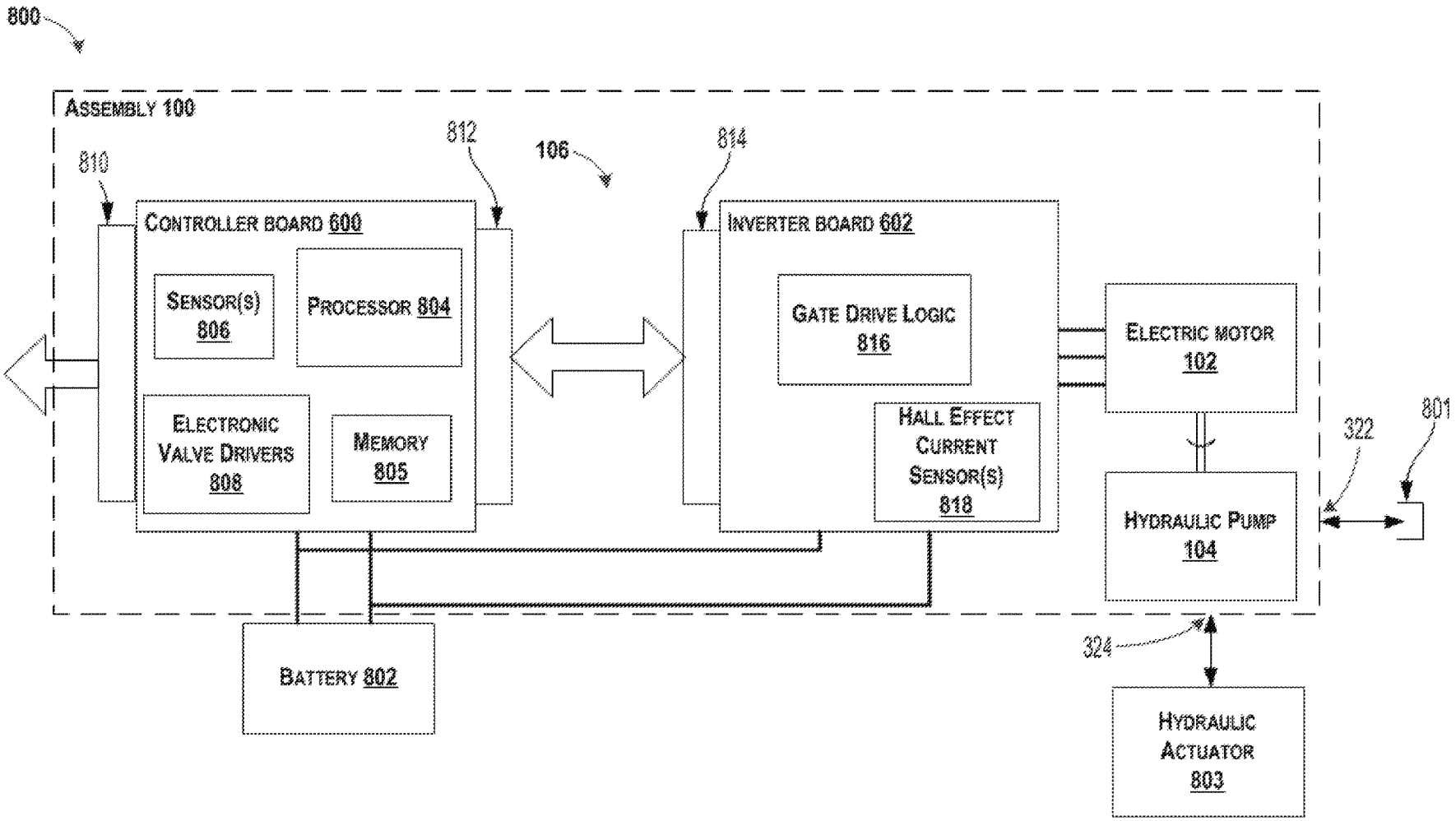
FIG. 8 illustrates a block diagram of a system that includes a battery, a hydraulic actuator, and an assembly of an electric motor, a hydraulic pump, and a motor controller, in accordance with an example implementation.

FIG. 8 illustrates a block diagram of a system 800 that includes a source of direct current power such as a battery 802, a hydraulic actuator 803, and the assembly 100, in accordance with an example implementation. The battery 802 can be configured to provide power to the motor controller 106 (e.g., to the controller board 600 and the inverter board 602). The motor controller 106 then controls the electric motor 102 to drive the hydraulic pump 104. The hydraulic pump 104 can draw fluid from a fluid reservoir 801 through the inlet port 322 and can provide or receive fluid flow to and from the hydraulic actuator 803 (e.g., via the outlet port 324) to control motion of the hydraulic actuator 803.

The hydraulic actuator 803 can also be fluidly coupled to the fluid reservoir to provide return fluid flow thereto. The hydraulic actuator 803 can, for example, by a hydraulic linear cylinder actuator with a piston linearly movable therein or a hydraulic motor.

As mentioned above, the controller board 600 can have one or more processors such as processor 804 configured to execute computer-readable program instructions (CRPI) that can be stored in a memory 805 coupled to the controller board 600. The memory 805 can include any type of computer readable medium (non-transitory medium) or memory, such as a storage device including a disk or hard drive, to store the program code that when executed by the processor 804 cause the system 800 to perform the operations described herein. The controller board 600 can also include sensor(s) 806, including the encoder 716 described above.

As mentioned above, in example implementations, a manifold can be coupled to the end cover 130, and such manifold can include a plurality of solenoid valves that control fluid flow and pressure levels of fluid flowing into and out of the assembly 100. In these implementations, the controller board 600 may further include electronic valve drivers 808 (e.g., analog valve driver circuits or microprocessor-based solenoid controllers) configured to receive a command signal and in response generate a current or voltage to actuate a solenoid actuator of a valve.

The controller board 600 can have a junction 810 configured to be electrically-connected to external components such as solenoid coils of solenoid valves. In examples, the battery 802 can be electrically-coupled to the controller board 600 via the junction 810.

The controller board 600 can have another junction 812 configured to be electrically-coupled to a junction 814 of the inverter board 602 so as to facilitate exchange of signals therebetween. For example, the inverter board 602 can include a gate drive logic module 816 that includes the semiconductor switching matrix 706. The controller board 600 can send the PWM signal described above to the inverter board 602 via the junctions 812, 814 to actuate the gate drive logic module 816 and generate the three-phase AC power that drives the electric motor 102.

On the other hand, the inverter board 602 can include Hall-Effect current sensors 818 configured to measure electric current provided to the wire windings of the stator 110 of the electric motor 102. The inverter board 602 can provide sensor information from the Hall-Effect current sensors 818 via the junctions 812, 814 to the processor 804 of the controller board 600. The processor 804 can then implement a closed-loop feedback control strategy to control the electric motor 102 and provide a particular flow rate from the hydraulic pump 104 coupled to the electric motor 102.

Components of the system 800 may be configured to work in an interconnected fashion with each other and/or with other components coupled to respective systems. One or more of the described operations or components of the system 800 may be divided up into additional operational or physical components, or combined into fewer operational or physical components. In some further examples, additional operational and/or physical components may be added to the examples illustrated by FIG. 8. Still further, any of the components or modules of the system 800 may include or be provided in the form of a processor (e.g., a microprocessor, a digital signal processor, etc.) configured to execute program code including one or more instructions for implementing logical operations described herein. In an example, the system 800 may be included within other systems.

Several configuration variations can be implemented to the example implementation depicted in FIGS. 1-8. For example, rather than having the main housing 108 coupled to the controller housing 134, which is configured as a separate housing, both housings can be combined into a single housing. As another example, rather than using an internal gear pump, an external gear pump or a different pump type can be used. Also, in another example implementation, a planetary gearbox might not be used, and the rotor may be coupled directly to the pump shaft. Also, while the hydraulic pump 104 is disposed partially within the stator 110, in another example implementation, the pump can be disposed completely within the windings of the stator.

Such example variations are described below with respect to FIG. 9. However, it should be understood that certain aspects of the implementation of FIGS. 1-8 and the implementation of FIG. 9 can be arranged and combined in a wide variety of different configurations, all of which are contemplated herein. Further, unless context suggests otherwise, the features illustrated in the implementation of FIGS. 1-8 may be used in combination with features illustrated in the implementation of FIG. 9.

Figure 9:
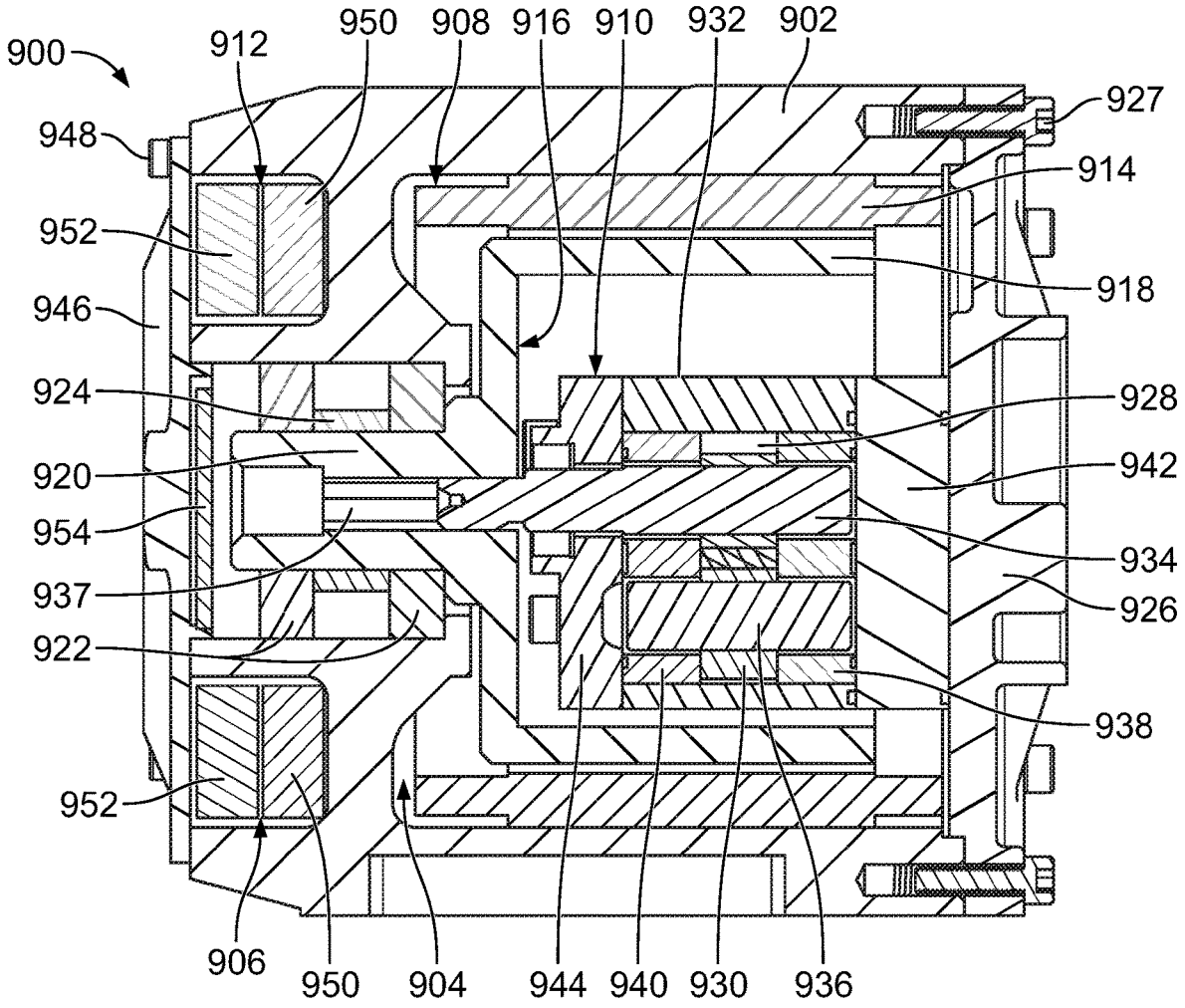
FIG. 9 illustrates a cross-sectional side view of an assembly, in accordance with an example implementation.

FIG. 9 illustrates a cross-sectional side view of an assembly 900, in accordance with an example implementation. The assembly 900 comprises a housing 902 that has a pump-motor chamber 904 and a controller chamber 906. The pump-motor chamber 904 houses or contains an electric motor 908 and a hydraulic pump 910, whereas the controller chamber 906 houses or contains a motor controller 912.

With this configuration, rather than two separate housings, one for the pump and electric motor and another for the motor controller, the housing 902 has a unitary construction (e.g., made as a single housing or single block) with a chamber for the electric motor 908 and the hydraulic pump 910 and another chamber for the motor controller 912. Also, similar to the configuration of FIGS. 1-6, the electric motor 908, the hydraulic pump 910, and the motor controller 912 are integrated together in the assembly 900.

The electric motor 908 includes a stator 914 fixedly positioned within the pump-motor chamber 904 of the housing 902. The stator 914 is configured similar to the stator 110 and generates a magnetic field when an electric current is provided through its wire windings. The stator 914 differs from the stator 110 in that the stator 914 extends axially through substantially the entire length of the pump-motor chamber 904.

The electric motor 908 further includes a rotor 916 positioned in an annular space within the stator 914. The rotor 916 rotates when the stator 914 generates a magnetic field. The rotor 916 has a cylindrical portion 918 and a spindle portion 920. The spindle portion 920 is supported within the housing 902 via support bearings 922 to allow the rotor 916 to rotate relative to the housing 902. A spacer 924 separates the support bearings 922 from each other. In another example, a single bearing is used similar to the configuration in FIG. 2.

The hydraulic pump 910 is mounted within the housing 902, completely within the stator 914 of the electric motor 102. In other words, the hydraulic pump 910 extends axially to substantially the same extent as the stator 914. The hydraulic pump 910 is fixedly mounted to an end cover 926 that is coupled to the housing 902 via a plurality of bolts such as bolt 927.

The hydraulic pump 910 is similar to the hydraulic pump 104 in that they are both gear pumps. However, the hydraulic pump 910 is an external gear pump having two external gears rather than an internal gear pump (like the hydraulic pump 104) having an external gear disposed within a ring gear.

Particularly, the hydraulic pump 910 has a pump pinion 928 (e.g., an external spur gear having external teeth formed in an exterior peripheral surface thereof) and a pump external gear 930 (e.g., an external spur gear having external teeth formed in an exterior peripheral surface thereof) disposed within a pump housing 932, such that external teeth of the pump pinion 928 are configured to engage with external teeth of the pump external gear 930. The pump pinion 928 is mounted to, or is an integral portion of, a drive shaft 934, and the pump external gear 930 is mounted to a pump shaft 936, that is disposed parallel to the drive shaft 934. The drive shaft 934 has external splines engaging with internal splines 937 of the spindle portion 920 such that the rotary motion of the rotor 916 is transmitted to the drive shaft 934.

The pump external gear 930 and the pump pinion 928 are axially supported by thrust plates 938, 940 on both sides of thereof. Similar to the thrust plates 340, 342, the thrust plates 938, 940 operate as axial compensators that can reduce leakage, and improve efficiency of the hydraulic pump 910.

The thrust plates 938, 940 are in turn supported by a front cover 942 and a back cover 944. Similar to the front cover 344 and the back cover 346, the front cover 942 and the back cover 944 can have a pressure compensation pocket that is filled with pressurized fluid received through the thrust plates 938, 940, and the pressurized fluid then helps to push the thrust plates 938, 940 against the pump external gear 930 and the pump pinion 928 for sealing.

The assembly 900 further includes a housing cover 946 that is coupled to the housing 902 via a plurality of bolts, such as bolt 948. With this configuration, the housing 902 and the housing cover 946 form an enclosure, i.e., the controller chamber 906, in which the motor controller 912 is disposed. This way, the motor controller 912 is embedded within the assembly 900 and integrated with the electric motor 908 and the hydraulic pump 910 in the assembly 900.

The motor controller 912 can include a controller board 950 and an inverter board 952 that are axially offset from each other as depicted. The controller board 600 and the inverter board 602 can be configured as PCBs and can operate in a manner similar to the controller board 600 and the inverter board 602 described above.

The assembly 900 further includes an encoder 954 mounted near the spindle portion 920 of the rotor 916. Similar to the encoder 716, the encoder 954 can be configured as an electro-mechanical device that converts the angular position or motion of the rotor 916 to analog or digital output signals that are provided to the microprocessor controlling the electric motor 908. Other types of angular position sensors may be used.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. An assembly comprising:

a main housing having an internal chamber therein;

an electric motor disposed in the internal chamber of the main housing and comprising (i) a stator fixedly positioned in the internal chamber of the main housing, and (ii) a rotor positioned within the stator;

a hydraulic pump positioned in the main housing and at least partially within the rotor of the electric motor, wherein the hydraulic pump is configured to receive fluid from an inlet port and provide fluid flow to an outlet port, wherein the hydraulic pump comprises a pump shaft;

a rotor shaft coupled to the rotor, wherein the pump shaft is coaxial with and is rotatably coupled to the rotor shaft;

a gearbox disposed within the rotor and configured to couple the rotor shaft to the pump shaft and reduce rotational speed of the pump shaft relative to the rotor;

a controller housing coupled to the main housing; and a motor controller comprising one or more circuit boards disposed within the controller housing and configured to generate electric current to drive the electric motor.

2. The assembly of claim 1, further comprising:

an end cover coupled to the main housing and comprising the inlet port and the outlet port.

3. The assembly of claim 1, wherein the rotor comprises a cylindrical portion and a spindle portion, and wherein the pump shaft is rotatably coupled to the spindle portion.

4. The assembly of claim 3, wherein the rotor shaft is coupled to the spindle portion of the rotor.

5. The assembly of claim 4, wherein the gearbox is disposed within the cylindrical portion of the rotor.

6. The assembly of claim 5, wherein the gearbox is a planetary gearbox comprising:

a sun gear coupled to the rotor shaft;

a plurality of planet gears engaging with the sun gear;

a planetary carrier coupled to the plurality of planet gears; and a gearbox ring gear, wherein the plurality of planet gears are configured to engage with inner teeth of the gearbox ring gear, and wherein the planetary carrier is coupled to the pump shaft.

7. The assembly of claim 4, wherein the spindle portion of the rotor is supported within the main housing on at least one bearing allowing rotation of the rotor relative to the main housing.

8. The assembly of claim 1, wherein the hydraulic pump is a gear pump comprising:

a pump housing disposed within the internal chamber of the main housing and at least partially within the rotor;

a pump ring gear disposed within the pump housing; and a pump pinion coupled to the pump shaft and disposed within the pump ring gear, such that external teeth of the pump pinion are configured to engage with internal teeth of the pump ring gear.

9. The assembly of claim 1, further comprising:

a controller housing cover coupled to the controller housing such that the controller housing cover and the controller housing form an enclosure in which the one or more circuit boards of the motor controller are disposed.

10. An assembly comprising: a main housing having an internal chamber therein; an electric motor disposed in the internal chamber of the main housing and comprising (i) a stator fixedly positioned in the internal chamber of the main housing, and (ii) a rotor positioned within the stator; a hydraulic pump positioned in the main housing and at least partially within the rotor of the electric motor, wherein the hydraulic pump is configured to receive fluid from an inlet port and provide fluid flow to an outlet port, wherein the hydraulic pump comprises a pump shaft; a controller housing coupled to the main housing; and a motor controller comprising one or more circuit boards disposed within the controller housing and configured to generate electric current to drive the electric motor, wherein the one or more circuit boards comprise: an inverter board having a semiconductor switching matrix mounted thereon, wherein the semiconductor switching matrix comprises a plurality of semiconductor switching devices configured to convert direct current power to three-phase alternating current power to drive the electric motor 2 and a controller board axially offset from the inverter board and electrically coupled to the inverter board, wherein the controller board comprises a processor configured to generate switching signals to operate the semiconductor switching matrix.

11. The assembly of claim 10, wherein the controller board further comprises an encoder mounted thereto and configured to send sensor information to the processor indicative of a rotary position of the rotor.

12. The assembly of claim 10, further comprising:

a plurality of bus bars mounted to the inverter board; and battery leads coupled to the plurality of bus bars and configured to receive direct current power from a battery.

13. The assembly of claim 1, wherein the hydraulic pump is axially positioned completely within the stator of the electric motor.

14. The assembly of claim 1, wherein the main housing and the controller housing form a single housing configured as a single block comprising (i) a pump-motor chamber containing the hydraulic pump and the electric motor, and (ii) a controller chamber containing the motor controller.

15. A system comprising:

a source of direct current power;

a fluid reservoir;

a hydraulic actuator; and an assembly comprising:

a main housing having an internal chamber therein, an electric motor disposed in the internal chamber of the main housing and comprising (i) a stator fixedly positioned in the internal chamber of the main housing, and (ii) a rotor positioned within the stator, a hydraulic pump positioned in the main housing and at least partially within the rotor of the electric motor, wherein the hydraulic pump is configured to receive fluid from an inlet port fluidly coupled to the fluid reservoir and provide fluid flow to an outlet port fluidly coupled to the hydraulic actuator, wherein the hydraulic pump comprises a pump shaft, a rotor shaft coupled to the rotor, wherein the pump shaft is coaxial with and is rotatably coupled to the rotor shaft, a gearbox disposed within the rotor and configured to couple the rotor shaft to the pump shaft and reduce rotational speed of the pump shaft relative to the rotor, a controller housing coupled to the main housing, and a motor controller comprising one or more circuit boards disposed within the controller housing, wherein the one or more circuit boards are configured to receive direct current power from the source of direct current power and generate electric current to drive the electric motor.

16. The system of claim 15, wherein the one or more circuit boards comprise: an inverter board having a semiconductor switching matrix mounted thereon, wherein the semiconductor switching matrix comprises a plurality of semiconductor switching devices configured to convert direct current power to three-phase alternating current power to drive the electric motor; and a controller board axially offset from the inverter board and electrically coupled to the inverter board, wherein the controller board comprises a processor configured to generate switching signals to operate the semiconductor switching matrix.

17. The system of claim 16, wherein the controller board further comprises an encoder mounted thereto and configured to send sensor information to the processor indicative of a rotary position of the rotor.

18. The system of claim 16, wherein the assembly further comprises: a plurality of bus bars mounted to the inverter board and electrically coupled to the source of direct current power.

19. The system of claim 16, wherein the inverter board further comprises a plurality of Hall-Effect current sensors configured to measure electric current of the electric motor.

20. The system of claim 16, wherein the controller board further comprises an electronic valve driver configured to control operation of a solenoid valve.

* * * * *